US009010221B2

(12) United States Patent
Neumann

(10) Patent No.: US 9,010,221 B2
(45) Date of Patent: Apr. 21, 2015

(54) ASSEMBLY PLIERS WITH DETACHABLE COUNTER-RATCHET

(75) Inventor: Rainer Neumann, Herten (DE)

(73) Assignee: Vulkan Lokring-Rohrverbindungen GmbH & Co. KG, Herne (DE)

( * ) Notice: Subject to any disclaimer, the term of this patent is extended or adjusted under 35 U.S.C. 154(b) by 270 days.

(21) Appl. No.: 13/504,228

(22) PCT Filed: Oct. 22, 2010

(86) PCT No.: PCT/EP2010/006456
§ 371 (c)(1),
(2), (4) Date: Jun. 11, 2012

(87) PCT Pub. No.: WO2011/054450
PCT Pub. Date: May 12, 2011

(65) Prior Publication Data

US 2012/0247283 A1 Oct. 4, 2012

(30) Foreign Application Priority Data

Oct. 27, 2009 (DE) ..... 10 2009 050 865

(51) Int. Cl.
*B25B 7/12* (2006.01)
*B25B 7/16* (2006.01)
*B25B 27/10* (2006.01)

(52) U.S. Cl.
CPC ... *B25B 7/12* (2013.01); *B25B 7/16* (2013.01); *B25B 27/10* (2013.01)

(58) Field of Classification Search
CPC ..... B25B 7/00; B25B 7/04; B25B 7/10; B25B 7/12; B25B 7/16; B25B 7/18; B27B 27/00; B27B 27/10; B27B 27/14; B27B 27/16; B27B 27/205
USPC ..... 81/314, 318–320, 352, 353, 355–357, 81/362
See application file for complete search history.

(56) References Cited

U.S. PATENT DOCUMENTS

| | | | | |
|---|---|---|---|---|
| 2,643,564 | A * | 6/1953 | Klein et al. | 81/314 |
| 2,993,275 | A | 7/1961 | Naito | |
| 3,084,432 | A | 4/1963 | Hill | |
| 3,169,307 | A | 2/1965 | Langwell | |
| 4,742,737 | A * | 5/1988 | Hatfield | 81/355 |
| 5,511,453 | A * | 4/1996 | | 81/362 |

(Continued)

FOREIGN PATENT DOCUMENTS

| | | |
|---|---|---|
| DE | 367 658 | 1/1923 |
| DE | 36 22 392 | 1/1988 |
| DE | 43 32 710 | 2/1995 |

OTHER PUBLICATIONS

International Search Report of PCT/EP2010/006456, Jan. 28, 2011.

* cited by examiner

*Primary Examiner* — Hadi Shakeri
(74) *Attorney, Agent, or Firm* — Collard & Roe, P.C.

(57) ABSTRACT

Hand pliers for assembly purposes includes an assembly limb and a handle limb rotatably connected to one another via a first link joint. The handle limb is divided into an off-handle lever and a handle-near lever and these two levers are rotatably connected to one another by a bolt via a second link joint, wherein a tension wheel and a ratchet wheel with external toothing connected torsionally proof to it are pivotably arranged on the bolt side by side in axial direction, and the tension wheel engages into a tension device that connects both handle limbs to one another, and a spring-loaded dog ratchet is arranged at the handle-near lever, engaging into the ratchet wheel in such a manner that when the handle-near lever makes a latching movement it permits a rotation of the ratchet wheel on closing the pliers, but prevents its rotation in the opposite direction.

3 Claims, 2 Drawing Sheets

ASSEMBLY PLIERS WITH DETACHABLE COUNTER-RATCHET

CROSS REFERENCE TO RELATED APPLICATIONS

This application is the National Stage of PCT/EP2010/006456 filed on Oct. 22, 2010, which claims priority under 35 U.S.C. §119 of German Application No. 10 2009 050 865.1 filed Oct. 27, 2009, the disclosure of which is incorporated by reference. The international application under PCT article 21(2) was not published in English.

BACKGROUND OF THE INVENTION

1. Field of the Invention

The invention relates to a hand pliers for assembly purposes, more particularly for the assembly of pipe connections at pipe systems, said pliers comprised of two limbs which are rotatably connected to one another via a first link joint and which by means of this link joint are divided into an assembly limb and a handle limb, wherein the first handle limb is divided into a lever away from the handle and into a lever close to the handle, and wherein these two levers are rotatably connected to one another by means of a bolt via a second link joint, wherein a tension wheel and a ratchet wheel with external toothing connected torsionally proof to it are pivotably arranged side by side on the bolt in axial direction, and wherein the tension wheel engages into a tension means that connects both handle limbs to one another, and wherein a spring-loaded dog ratchet is arranged at the lever near the handle, said dog ratchet engaging into the ratchet wheel in such a mariner that when the lever near the handle makes a locking movement the ratchet wheel and the tension wheel execute a rotation that causes the closing of the pliers, with a spring-loaded arrest ratchet being provided for which also engages in the ratchet wheel and permits a rotation of the ratchet wheel on closing the pliers, but which prevents its rotation in the opposite direction.

2. Description of the Related Art

A hand pliers of this type is known from printed publication DE 43 32 710 A1. Hand pliers of this type are utilized in the assembly of pipe systems, viz. for the manufacture of sliding sleeve-type pipe connections. In prior art, a spring-back of the handle limbs on clamping the pliers is prevented in that the ratchet wheel—as described in printed publication DE 43 32 710 A1—is provided with a ratchet toothing extending over its entire circumference into which a spring-loaded arrest ratchet comes in engagement. The toothing is so configured that a rotation of the ratchet wheel on clamping the pliers is admitted, though a counter-rotation is prevented. The arrest ratchet is swivel-mounted at a bolt and is brought into engagement with the ratchet wheel by way of spring loading.

Difficulties arise on releasing the arrest ratchet from the ratchet wheel if pipe systems with major nominal widths are mounted. It becomes evident that so high assembly forces may occur during this process that the arrest ratchet gets stuck in the ratchet wheel and cannot be detached any longer.

SUMMARY OF THE INVENTION

Now, therefore, it is the object of the present invention to provide a hand pliers whose arrest ratchet can be detached even if it is subjected to great assembly forces.

To solve this task, the invention based on the prior art outlined hereinabove provides for a switch by the actuation of which the direction of the spring load of the arrest ratchet is reversible in such a manner that the actuation of the switch takes the effect that the engagement of the arrest ratchet into the ratchet wheel is abolished.

By means of the inventive switch, the spring load of the arrest ratchet is optionally altered so that after actuating the switch the arrest ratchet, e.g. in case of a slight further latching movement of the handle levers, detaches itself automatically from the toothing of the ratchet wheel.

In addition, it is provided for that the tension means is guided in a pulley block arrangement from the tension wheel via a diversion wheel arranged at the second handle limb and from there back to the first handle limb. By guiding the tension means (e.g. a chain) in a pulley block arrangement, said tension means basically connecting the two handle limbs to each other via the diversion wheel at the second handle limb, the force to be applied by the user can be reduced substantially.

A tension means guidance is expediently arranged near the tension wheel at the lever near the handle, said tension means guidance taking the effect that the wrap angle of the tension means about the tension wheel amounts at least to 90°. By way of a greater wrap angle about the tension wheel, the interaction length of the tension means rises with the tension wheel which leads to an increase of the maximally transferrable tension force. Likewise, it results a reduced local load of the tension wheel as well as a more stable position of the tension means at the tension wheel.

BRIEF DESCRIPTION OF THE DRAWINGS

A practical example of the inventive hand pliers is elucidated in greater detail in the following based on the drawings, where.

DETAILED DESCRIPTION OF THE PREFERRED EMBODIMENTS

Figure 1:
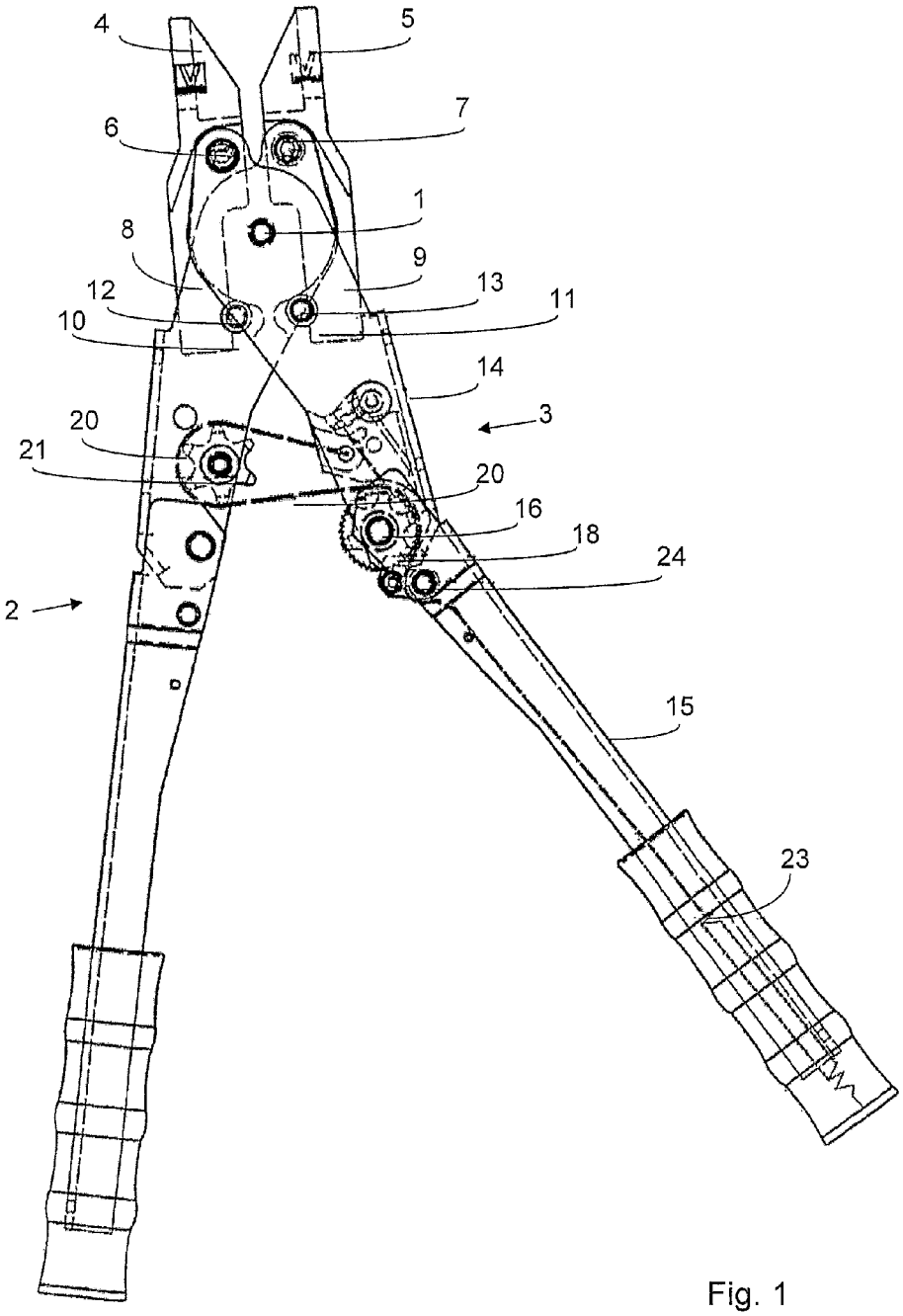
FIG. 1 shows a lateral view of the hand pliers in the latching position.

The illustrated hand pliers comprises two limbs held together through a link joint with a bolt 1 which are subdivided each into an assembly limb and a handle limb 2 and 3. The two limbs are comprised of U-shaped bent sheet metal profiles which face each other with their open sides. At the head section of the hand pliers, the sheet metal profiles are shaped like a yoke, with the handle limb 3 enclosing the opposite handle limb 2 in form of a U-shape. Bolt 1 is held in axially secured position in the aligned bores of the limbs.

At the free ends of the assembly limbs, one assembly jaw 4 and/or 5 each is articulately held by the aid of one support bolt 6 and/or 7. At the opposite ends of the assembly limbs, one guidance ledge 8 and/or 9 each is molded with an inner straight supporting area 10 and/or 11. Each supporting surface area 10 and/or 11 rests as a counter-bearing at a pin 12 and/or 13 retained in the relevant handle limb 2 and/or 3. The supporting bolts 6, 7 and the pins 12, 13 with their axes form the link points of a four-bar linkage. On opening and closing the hand pliers, the assembly jaws 4, 5 move towards each other whilst maintaining their parallel position.

While the handle limb 2 is a straight-through part, the other handle limb 3 which by its shape is in congruence with the handle limb 2 is subdivided near the head of the hand pliers into a shorter lever 14 away from the handle and into a longer lever 15 near the handle which are articulately connected to each other by way of a second link joint with a bolt 16.

As becomes evident more particularly from FIG. 1, the link bolt 16 concurrently is a bearing bolt for a tension wheel 17 and a ratchet wheel 18 with circumferential teething torsion-proof connected to it. The tension wheel 17 and the ratchet wheel 18 are torsion-proof seated on a sleeve 19, which in its axial length extends with a small play within the U-shaped profile of the lever 14 away from the handle. The tension wheel, ratchet wheel, and the sleeve may also be configured as one-part units.

Via the tension wheel 17, a tension means 20, preferably comprised of a plate link chain, said tension means being laid at the handle limb 2 over a diversion wheel 21 and guided to the handle part 14 in accordance with a pulley block arrangement back to the handle part 14. Arranged close to the tension wheel 17 at the handle-near lever 15 is a tension means guidance 22 which takes the effect that the wrap angle of the tension means 20 about the tension wheel 17 at least amounts to 90°. In the direction of the pliers handle, the tension means 20 extends in the interior of the U-shape bent handle-near lever 15, with its free end being attached via a tension spring 23 at the lever 15. The tension spring 23 serves for tightening-up the non-loaded section of the tension means 20.

Arranged at the handle-near lever 15 in vicinity to the ratchet wheel 18 is a ratchet bolt 24 which is appropriately secured against axial shifting. In the plane of the ratchet wheel 18, this ratchet bolt 24 carries a dog ratchet 25 which can engage with a nose 26 into the peripheral toothing 27 of the ratchet wheel 18. Acting upon the dog ratchet 25 is a retention spring which is destined for retaining the dog ratchet 25 in its position of engagement with the ratchet wheel 18.

Figure 3:
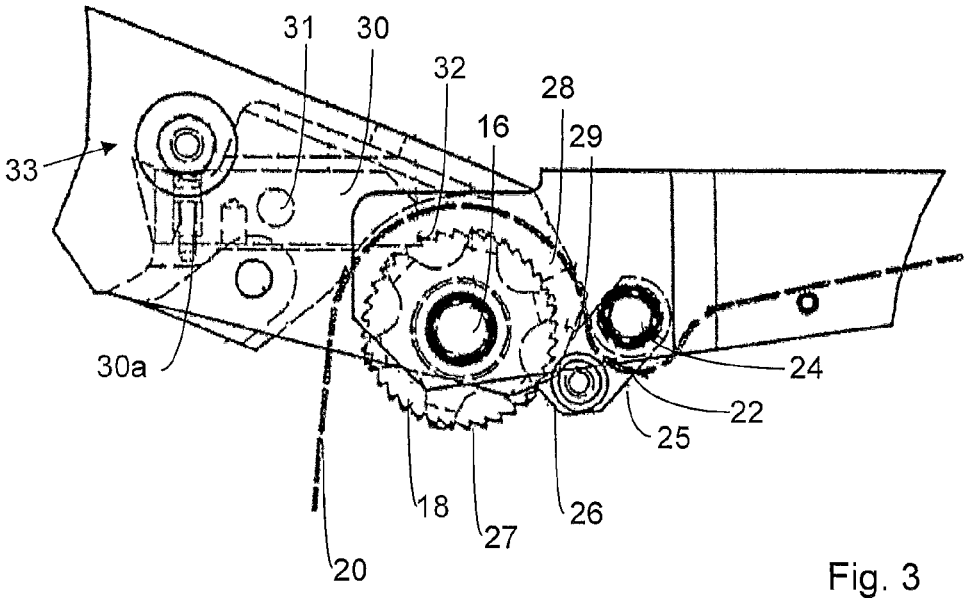
FIG. 3 shows an enhanced lateral view of the second link joint.

As shown in FIGS. 1 and 3, the handle-near lever 15 can be swung from its idle position versus the off-handle lever 14 outwardly into a final position which is confined by an arrest stop. Prior to reaching the final position of the swivel movement of the handle-near lever 15, the dog ratchet 25 is automatically swung from the position of engagement into a free position. For this purpose, a ramp nose 28 is molded at the off-handle lever 14 by way of which an inner gliding surface 29 of the dog ratchet 25 comes into a pressure contact at the beginning of the final phase of the swiveling movement.

The off-handle lever 14 comprises an arrest ratchet 30 which is pivoted at a bolt 31. At its free end, the arrest ratchet 30 carries a latching tooth 32 which under spring load, too, engages into the toothing 27 of the ratchet wheel 18.

A switch 33 is provided for, by the actuation of which the direction of the spring loading of the arrest ratchet 30 is reversible.

The pliers function works as follows:

During the opening movement of the hand pliers, the handle-near lever 15 initially swivels into the final position shown in FIG. 1. Only afterwards does a spreading movement of the off-handle lever 14 and thus a spreading-apart of the assembly jaws 4 and 5 occur. Vice-versa, on closing the hand pliers, the off-handle lever 14 of the first handle limb 3 is pressed towards the second handle limb 2 until the assembly jaws 4 and 5 come to rest at the pipe connecting parts to be mounted. Afterwards, the swivel movement of the handle-near lever 15 is initiated, while the dog ratchet 25 with its nose 26 can engage into the toothing 27 of the ratchet wheel 18. As the handle-near lever 15 is moved on, the ratchet wheel 18 and thereby the tension wheel 17—relative to the illustration in FIG. 1—is turned clockwise. Due to the turning of the tension wheel 17, it moves alongside the tension means 20, whereby the tension means section between the diversion wheel 21 and the tension wheel 17 is subject to tensile strain. This tensile strain takes effect on the first handle limb 3 with the result that it is pressed towards the second limb in the sense of a closing movement of the hand pliers. In conformity with the principle of a pulley block mechanism, the diversion of the tension means 20 via an additional diversion wheel 21 at the second handle limb 2 ensures a halving of the force to be applied on closing the pliers. The additional tension means guidance 22 guides the tension means 20 about the tension wheel 17 in such a manner that the wrap angle is greater than 90°.

To prevent unintentional springiness of the pliers parts if subjected to very great assembly forces, a turning-back of the ratchet wheel 18 is prevented by means of the arrest ratchet 30. Arranged on the peripheral side averted from the dog ratchet 25 is the arrest ratchet 30 which co-acts with the peripheral toothing of the ratchet wheel 18. The arrest ratchet 30 is swivel mounted at the off-handle lever 14, confined by a fixed bolt 31, and at its free end it comprises a latching tooth 32 which engages into the toothing 27. The latching tooth 32 and the toothing 27 are so shaped that the arrest ratchet 30 permits a clockwise rotation of the ratchet wheel 18 relative to the illustration shown in FIG. 1—but prevents a counter-rotation.

In case that high assembly forces have to be applied, the arrest ratchet 30 and the ratchet wheel 18 are often so firmly engaged into each other that the arrest ratchet 30 does no longer detach itself from the toothing 27. To cope with this case, a switch 33 is provided for at the off-handle lever 14, and by actuating this switch the direction of the spring loading of the arrest ratchet 30 is reversible in such a manner that the actuation of the switch 33 takes the effect that the engagement of the arrest ratchet 30 into the ratchet wheel 18 is abolished.

Figure 2:
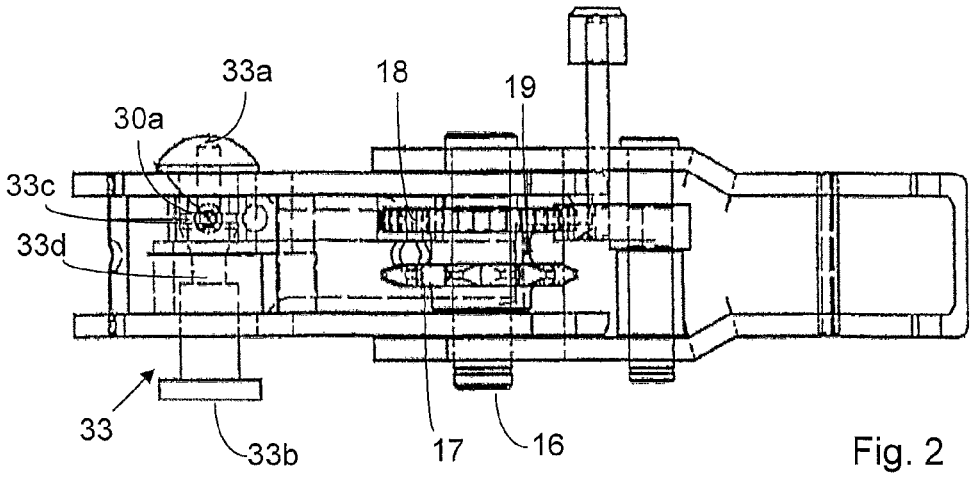
FIG. 2 shows a sectional view of the second link joint.

FIG. 2 shows the switch 33 in the actuated position. The switch 33 is configured in form of a stud. At its top side, the switch comprises a rounded-off actuation head 33*a*. An arrest plate 33*b* is arranged at its bottom side. The actuation head 33*a* and the arrest plate 33*b* confine the adjustment path of the switch 33. The shaft of switch 33 has a diameter that is variable along its longitudinal extension. The shaft is tapered from an area 33*c* having a larger diameter up to a circumferential groove 33*d*. In the position of switch 33 as shown in FIG. 2, a spring-loaded stud 30*a* mounted into the arrest ratchet 30 rests in area 33*c* at the shaft of the switch 33. The spring-loaded stud 30*a* which in this switching position supports itself at the shaft of the switch 33 causes a spring force to become effective that tries to move the latching tooth 32 away from the toothing 27. By axial shifting (relative to the illustration shown in FIG. 2 towards the top), it is achieved that the stud 30*a* is located at the level of the groove 33*d* where it cannot support itself any longer at the shaft of switch 33. In this switching position, an entirely modified spring force becomes active upon the arrest ratchet 30 which tries to move the latching tooth 32 towards the toothing 27. The engagement of the arrest ratchet 30 into the ratchet wheel is thereby established.

The invention claimed is:

1. Hand pliers for assembly purposes, said pliers comprising:

an assembly limb forming a first jaw and a handle limb forming a second jaw rotatably connected to one another via a first link joint;

said handle limb comprising an off-handle lever and a handle-near lever rotatably connected to one another by a bolt via a second link joint;

a tension wheel and a ratchet wheel with external toothing connected torsionally proof to it pivotably arranged side by side on the bolt in axial direction;

the tension wheel engaging into a tension device connecting the assembly limb and the handle limb;

a spring-loaded dog ratchet arranged at the handle-near lever;

said dog ratchet engaging into the ratchet wheel in such a manner that when the handle-near lever makes a latching movement the ratchet wheel and the tension wheel execute a rotation that causes the closing of the pliers;

a spring-loaded arrest ratchet engaging in the ratchet wheel permitting a rotation of the ratchet wheel on closing the pliers, but preventing its rotation in the opposite direction; and, a switch by the actuation of which the direction of the spring loading of the arrest ratchet is reversible, in such a manner that the actuation of the switch takes the effect that the engagement of the arrest ratchet into the ratchet wheel is abolished.

2. The hand pliers according to claim 1, wherein the tension device is guided in a pulley block arrangement from the tension wheel via a diversion wheel arranged at assembly limb and from there back to the handle limb.

3. The hand pliers according to claim 1, further comprising a tension device guidance arranged close to the tension wheel at the handle-near lever, said guidance ensuring that the wrap angle of the tension device about the tension wheel amounts at least to 90°.

* * * * *